US011318344B2

(12) United States Patent
Schepisi

(10) Patent No.: US 11,318,344 B2
(45) Date of Patent: May 3, 2022

(54) YOGA BAND AND METHOD OF USING SAID YOGA BAND TO PERFORM A YOGA POSE

(71) Applicant: Rosemarie J. Schepisi, Concord, NC (US)

(72) Inventor: Rosemarie J. Schepisi, Concord, NC (US)

(73) Assignee: R. PIZI LLC, Concord, NC (US)

( * ) Notice: Subject to any disclaimer, the term of this patent is extended or adjusted under 35 U.S.C. 154(b) by 0 days.

(21) Appl. No.: 17/608,526

(22) PCT Filed: Apr. 23, 2021

(86) PCT No.: PCT/US2021/028988

§ 371 (c)(1),
(2) Date: Nov. 3, 2021

(87) PCT Pub. No.: WO2021/236294

PCT Pub. Date: Nov. 25, 2021

(65) Prior Publication Data

US 2022/0080248 A1 Mar. 17, 2022

Related U.S. Application Data

(60) Provisional application No. 63/029,192, filed on May 22, 2020.

(51) Int. Cl.

| | |
|---|---|
| ***A63B 21/055*** | (2006.01) |
| ***A63B 21/00*** | (2006.01) |
| *A63B 23/00* | (2006.01) |

(52) U.S. Cl.
CPC ..... *A63B 21/0557* (2013.01); *A63B 21/4015* (2015.10); *A63B 21/4019* (2015.10); (Continued)

(58) Field of Classification Search
CPC ..... A63B 21/0557; A63B 21/4015; A63B 21/4019; A63B 21/4035; A63B 21/4043; A63B 2023/006
See application file for complete search history.

(56) References Cited

U.S. PATENT DOCUMENTS 4,441,707 A 4/1984 Bosch
5,588,941 A 12/1996 Scott
(Continued)

FOREIGN PATENT DOCUMENTS

KR 100606336 B1 7/2006

*Primary Examiner* — Joshua Lee
(74) *Attorney, Agent, or Firm* — Invention To Patent Services; Alex Hobson

(57) ABSTRACT

A yoga band is configured with a retainer band loop for donning around a hand, wrist or foot and both an inner pose strap and an outer pose strap that may be elastic to enable stretching and holding of poses. The inner pose strap and an outer pose enable different levels or extensions for performing yoga poses, or a progressive stretching from the outer pose strap to the inner pose strap, for example. A yogi may extend the outer pose strap initially, as it may extend further than the inner pose strap, and therefore may be easier to reach and hold the yoga pose. As the yogi progresses, they may extend the inner pose strap which is shorter in length, thereby achieving a greater stretch. The inner and outer pose straps are coupled with a retainer strap component of the retainer band loop to provide a secure support.

26 Claims, 12 Drawing Sheets

(52) U.S. Cl.
CPC ..... *A63B 21/4035* (2015.10); *A63B 21/4043* (2015.10); *A63B 2023/006* (2013.01)

(56) References Cited

U.S. PATENT DOCUMENTS

| | | | | |
|---|---|---|---|---|
| 6,450,930 | B1 * | 9/2002 | Kroke | A61H 1/0255 482/121 |
| 8,343,018 | B2 * | 1/2013 | Moulton | A63B 23/035 482/131 |
| 9,259,605 | B1 * | 2/2016 | Puig | A63B 23/1236 |
| 9,265,985 | B2 * | 2/2016 | Uygan | A63B 21/4013 |
| 9,914,004 | B2 * | 3/2018 | Hatfield | A61H 1/0266 |
| 10,105,275 | B2 * | 10/2018 | Zbinden | A63B 21/4015 |
| 11,213,418 | B2 * | 1/2022 | Knotts | A63B 23/02 |
| 2007/0265145 | A1 * | 11/2007 | Teng | A63B 21/0023 482/907 |
| 2011/0281699 | A1 * | 11/2011 | Torres | A63B 23/12 482/131 |
| 2012/0040808 | A1 * | 2/2012 | Khademi | A61H 1/0277 482/124 |
| 2012/0295777 | A1 * | 11/2012 | Zaki | A63B 21/4015 482/122 |
| 2012/0295779 | A1 * | 11/2012 | Ferguson, Jr. | A63B 21/00185 482/131 |
| 2013/0345032 | A1 * | 12/2013 | Aldridge | A61H 1/0292 482/131 |
| 2016/0206914 | A1 * | 7/2016 | Zaki | A63B 21/4015 |
| 2018/0178050 | A1 | 6/2018 | Prihar | |
| 2018/0185692 | A1 | 7/2018 | Wailes et al. | |

* cited by examiner

YOGA BAND AND METHOD OF USING SAID YOGA BAND TO PERFORM A YOGA POSE

CROSS REFERENCE TO RELATED APPLICATIONS

This invention claims the benefit of priority to U.S. provisional patent application No. 63/029,192, filed May 22, 2020; the entirety of which is hereby incorporated by reference herein.

BACKGROUND OF THE INVENTION

Field of the Invention

The invention relates a yoga band and methods of using the yoga band to perform a yoga pose.

Background

Yoga requires stretching to hold various positions. Many people utilize a strap to hold a pose, wherein the strap extends around the foot or hand. These straps are typically long, such as a meter or more in length and they can get in the way of movement or get tangles around a body part. These straps are held by one or both hands to secure the strap in a desired position. Therefore, the straps have to be located and picked up each time they are used for a position. This stopping to find the strap and then configuring it around a body part at the proper length takes time out of the yoga workout and is disruptive. The straps have no length adjustment and require the user to estimate the length required for each position and then hold the strap at the set length. Some of the straps have a metal D-ring for positioning the strap through the D-ring for adjusting the loop length. This D-ring can be disruptive when it bangs on the floor in between positions.

SUMMARY OF THE INVENTION

The invention is directed to a yoga band and methods of using the yoga band to perform a yoga pose. An exemplary yoga band comprises an inner pose strap and an outer pose strap that enable different levels or extensions for performing yoga poses. These pose straps may be elastic to allow a degree of extension for reaching and/or holding a pose. A yogi may extend the outer pose strap initially, as it may extend further than the inner pose strap, and therefore may be easier to reach and hold the yoga pose. As the yogi progresses, they may extend the inner pose strap which is shorter in length, thereby achieving a greater stretch. A yogi may even hold the retainer band loop, such as the retainer pose strap component for the deepest stretch. To accommodates poses, a yogi may select either pose strap at any time during practice. The yoga band has a retainer band loop that has a retainer loop opening for securing the yoga band to an appendage.

An exemplary yoga band has the inner and outer pose straps coupled to a first and second side of the yoga band. The pose straps extend toward the pose end of the yoga band and the retainer band loop is configured proximal to the retaining end. The retainer band loop has a retainer strap component that is a non-elastic material to secure the retainer band loop around an appendage as one of the inner or outer pose straps is extended from the pose end. The retainer strap component resists the force of the extension and presses on the appendage it is configured around. The retainer band loop may also have a retainer pose strap component that completes the retainer loop opening from the first side to the second side of the yoga band. The retainer pose strap component may be elastic and may enable the retainer loop opening to expand and contract for donning over various sized appendages. Note that the yoga band as described herein may be used for any number of activities where stretching and in particular, progressive stretching is performed, including physical therapy, martial arts, ballet and the like.

The retainer band loop may be adjustable in size by way of the retainer strap component having a first retainer extension and second retainer extension that can be secured together to change the size of the retainer loop opening. In an exemplary embodiment, the first retainer extension and second retainer extension comprise hook-and-loop fastener to enable quick detachable attachment of a desired overlap distance to change the retainer loop opening size.

The retainer band loop may be adjustable in size by way of a buckle, wherein the retainer band loop extends through the buckle. The retainer strap component may be coupled to a buckle such as being loop through buckle. In an exemplary embodiment, the yoga band comprises a first buckle on a first side and a second buckle on a second side of the yoga band. Again, the retainer band loop, such as the retainer strap component and/or the retainer pose strap component may be coupled to the first and/or second buckles to adjust the retainer loop opening size.

An exemplary retainer band loop may be sized to fit a variety of individuals and may be provided in small, medium, large and extra-large sizes, for example. An exemplary retainer band loop may have a diameter that is configured to fit a range of individuals comfortably, such as about 10 cm or more, about 12 cm or more, about 15 cm or more, about 17 cm or more, about 20 cm or more and any range between and including the diameters provided.

The inner and outer pose straps may be coupled to the retainer band loop on the first and second sides to enable adjustment of the retainer loop opening and to prevent squeezing of an appendage when the pose strap is extended. The pose straps are preferably coupled to the retainer strap component whereby extension forces from the pose straps are carried by the retainer strap component.

An exemplary inner and outer pose strap may be formed by a pose strap coil that extends through a buckle. The pose strap coil may enable greater extension as the coil may slip through the buckle to allow more of the pose strap to extend.

The inner and outer pose straps may have a length from their respective first end and second end to enable effective posing and stretching, such as about 25 cm or less, about 20 cm or less, about 18 cm or less, about 16 cm or less, about 14 cm or less, about 10 cm or less and any range between and including the length values provided. Also note that the outer pose strap is longer than the inner pose strap, as it extends concentrically over the inner pose strap. The outer pose strap may have a length that is greater than the inner pose strap by about 10% or more, about 20% or more, about 25% or more, about 30% or more, about 40% or more, about 50% or more and any range between and including the percentages provided.

The inner and outer pose straps may be made out of an elastic material, material, such as an elastic fabric or band wherein the pose strap can be pulled and stretched from the retainer band loop and then return to an original length upon removal of the tensile force. The pose straps may be extended an extension length from the retainer band loop and the outer pose strap may extend to a larger or greater extension length than the inner pose strap, such as by about 10% or more, about 20% or more, about 25% or more, about 30% or more, about 40% or more, about 50% or more and any range between and including the percentages provided. The extension length of the outer pose strap may be about 20 cm or more, about 25 cm or more about 30 cm or more about 35 cm or more about 40 cm or less and any range between and including the outer extension lengths provided. The extension length of the inner pose strap may be about 10 cm or more, about 15 cm or more about 20 cm or more about 25 cm or more about 30 cm or less and any range between and including the outer extension lengths provided. Again, the two pose straps enable a user to select the strap best suited for the particular pose and their ability. As a yogi advances, they may move from the outer pose strap fully extended to the inner pose strap for increases range of motion.

Any number of yoga poses may be performed using the yoga band as described herein. The yoga band may be configured with the retainer band loop around an appendage, such as a foot or hand, and one of the inner or outer pose straps may be extended from the retainer band loop to perform a yoga pose.

Elastic, as used herein, is defined as a material that can be stretched under a load and then return substantially to an original, unstretched length or shape upon removal of the load, wherein the material returns to at least 10% of the original length upon removal of the load. Note that holding an elastic material in a stretched and deformed position for long periods of time may compromise the elastic nature of the material.

Strap, as used herein, is defined as a planar length of material having two parallel opposing and extending surfaces.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
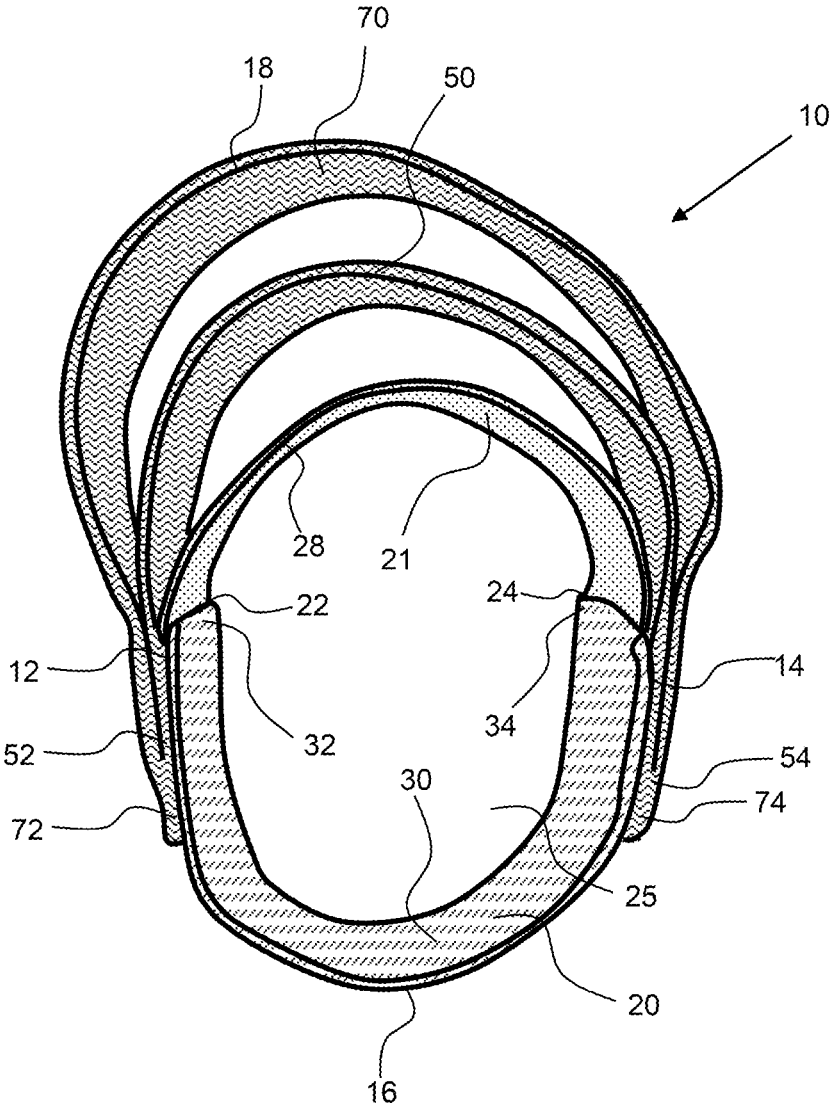
FIGS. 1 and 2 show an exemplary yoga band having a retainer band loop, an inner pose strap and an outer pose strap.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
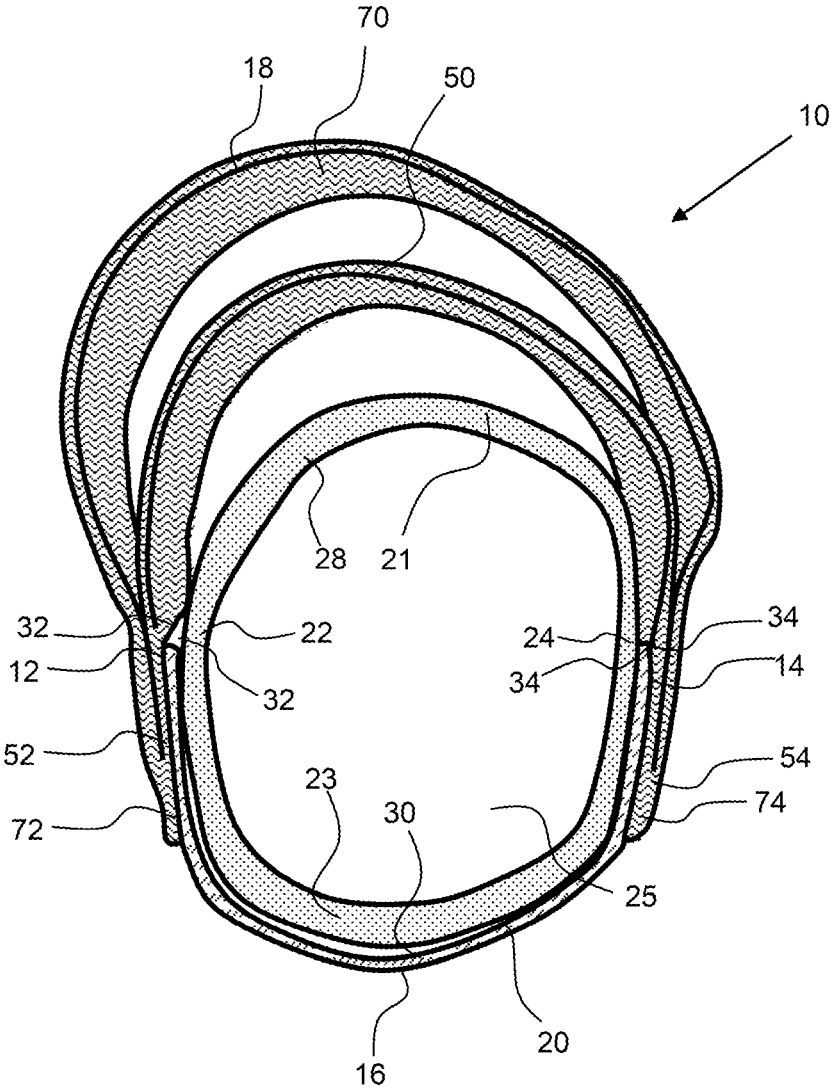

Referring now to FIGS. 1 and 2, an exemplary yoga band 10 has a retainer band loop 20, an inner pose strap 50 and an outer pose strap 70. The yoga band has a first side 12, a second side 14, a retaining end 16 and a pose end 18. The retaining end is secured by a person's hand or foot, for example, and one of the pose straps is stretched in an opposing direction from the retaining end. The retainer band loop has a retainer strap component 30 that extends from the first side to the second side and a retainer pose strap component 21. In FIG. 1 the retainer pose strap component is coupled with the retainer strap component on the first side and second side to form the retainer loop opening 25, wherein the retainer pose strap component extends from a first end 22 to a second end 24. As shown in FIG. 2, the retainer pose strap component extends in a loop and is coupled with the retainer strap component 30. A portion of the retainer pose strap component extends concentrically with the retainer strap component to produce a concentric overlap portion 23 which may be secured to the retainer strap component on the first side and second side of the yoga band or along the concentric overlap portion. The retainer pose strap component may be sewn to or otherwise attached to the retainer strap component over this concentric overlapped portion. The retainer strap component may be a non-elastic material to enable a person to secure the retainer band loop around their hand or foot. The retainer pose strap component may be elastic and form the adjustable component 28 of the retainer band loop to enable the retainer loop opening 25 to adjust to various sizes. The retainer strap component extends from a first end 32 to a second end 34. The retainer pose strap component extends from a first end 22 to a second end 24. The inner pose strap 50 extends from a first end 52 to a second end 54 that are coupled with the retainer band loop 20 on the first side 12 and second side 14, respectively. Likewise, the outer pose strap 70 extends from a first end 72 to a second end 74 that are coupled with the retainer band loop 20 on the first side 12 and second side 14, respectively. In this way, both of the inner and outer pose straps can be extended from the retainer band loop individually.

Figure 3:
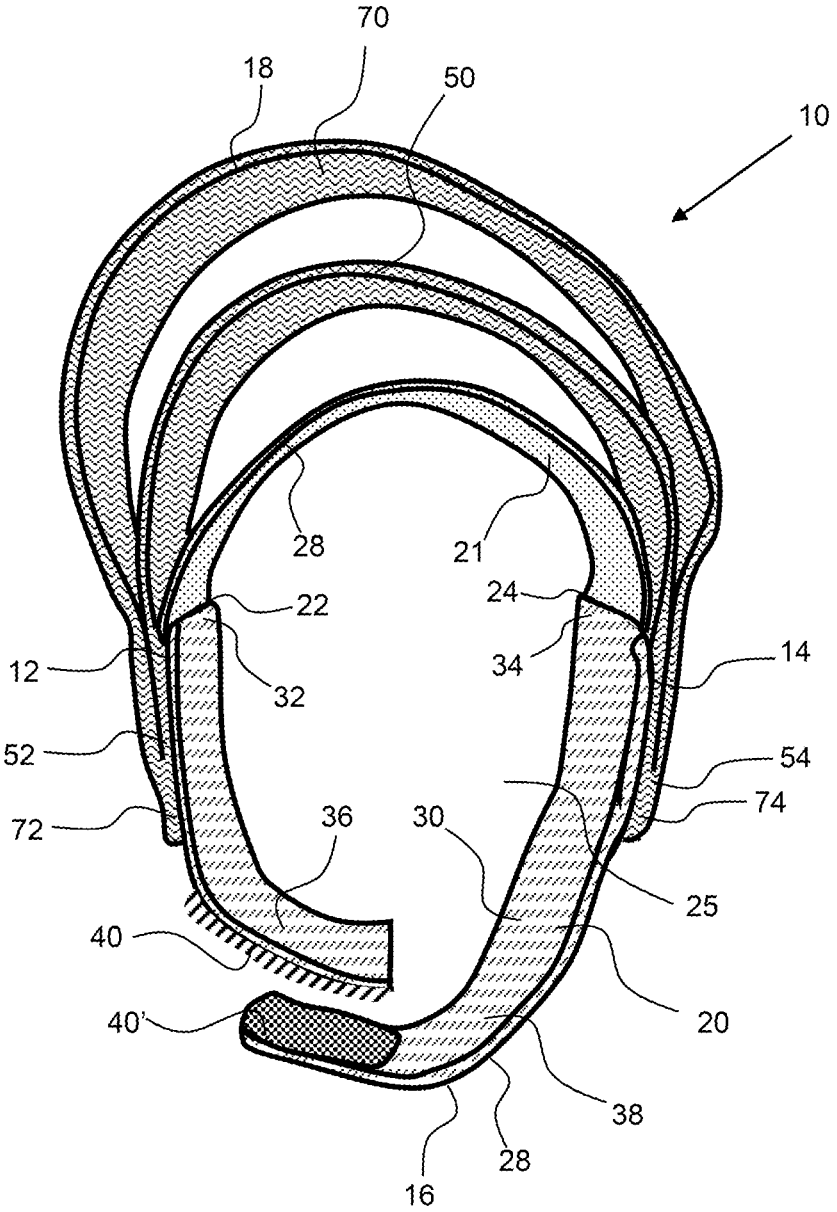
FIG. 3 shows an exemplary yoga band having a retainer band loop, an inner pose strap and an outer pose strap; wherein the retainer band loop has a first retainer extension and second retainer extension, each having hook-and-loop fastener to secure the yoga band to a hand or foot.

As shown in FIG. 3, the yoga band 10 has a retainer band loop 20 that has a first retainer extension 36 and second retainer extension 38 that form an adjustable component 28 of the retainer band loop. A first hook and loop fastener component 40 is configured on the first retainer extension 36 and a second hook-and-loop fastener component 40' is configure on the second retainer extension 38 to enable adjustment of the size of the retainer loop opening 25 size.

Figure 4:
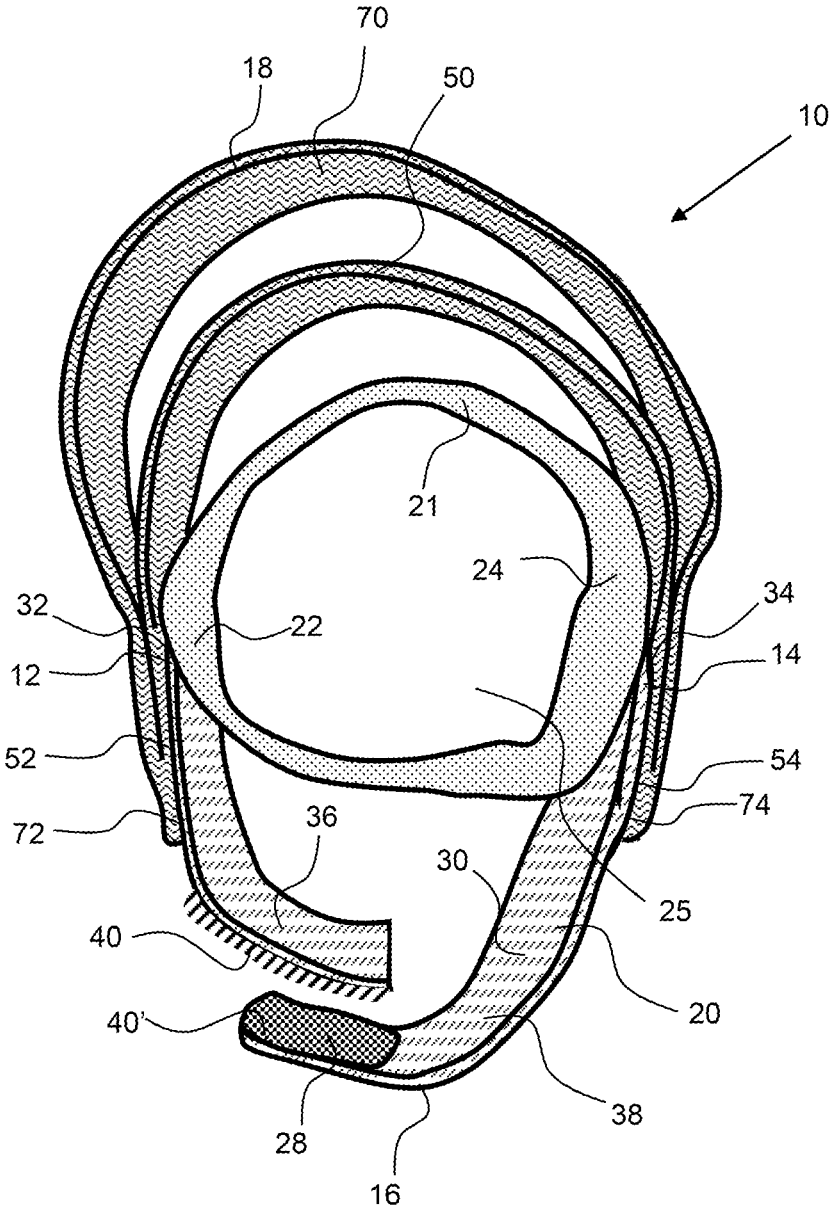
FIG. 4 shows an exemplary yoga band, wherein a retainer band loop has a retainer pose strap component that forms a complete loop and an inner pose strap and an outer pose strap.

As shown in FIG. 4, the yoga band 10 has a retainer pose strap component that forms a loop that is coupled with the retainer strap component on the first side 12 and second side 14 of the yoga band 10. The retainer band loop 20 has a first retainer extension 36 and second retainer extension 38 that form an adjustable component 28 of the retainer band loop. A first hook and loop fastener component 40 is configured on the first retainer extension 36 and a second hook-and-loop fastener component 40' is configure on the second retainer extension 38 to enable adjustment of the size of the retainer loop opening 25 size.

Figure 5:
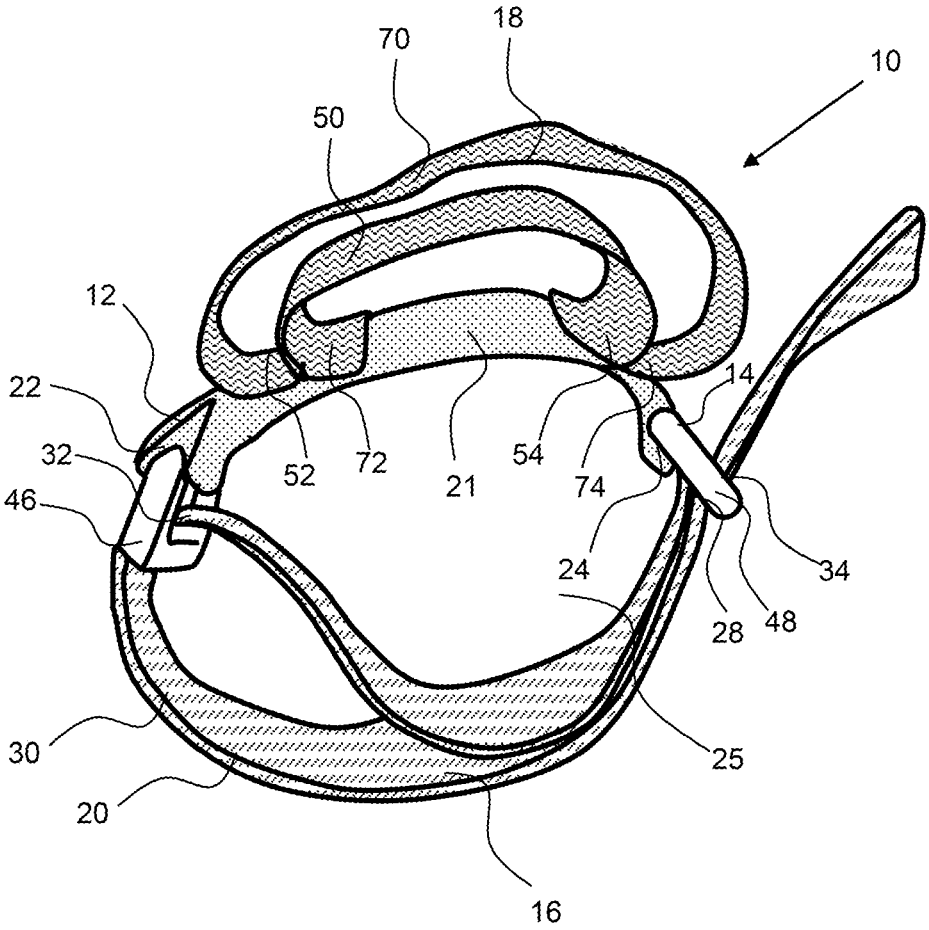
FIG. 5 shows an exemplary yoga band having a retainer band loop wherein the retainer strap component and retainer pose strap component extend through a first and second buckle on the first and second sides, respectively, of the yoga band.

As shown in FIG. 5, the yoga band 10 has a retainer band loop that comprises a first buckle 46 on a first side 12 and a second buckle 48 on a second side 14. The retainer strap component 30 extends through each of the buckles and the retainer pose strap component 21 extends through each of the buckles to form the retainer loop opening 25. The buckles have one or more openings for receiving the straps. The retainer strap component 30 is secured to the second buckle 48 and is looped through the first buckle to extend back through the second buckle. In this way, the retainer strap component can be tightened and the buckles form the adjustable component 28 for changing the retainer loop opening size.

Figure 6:
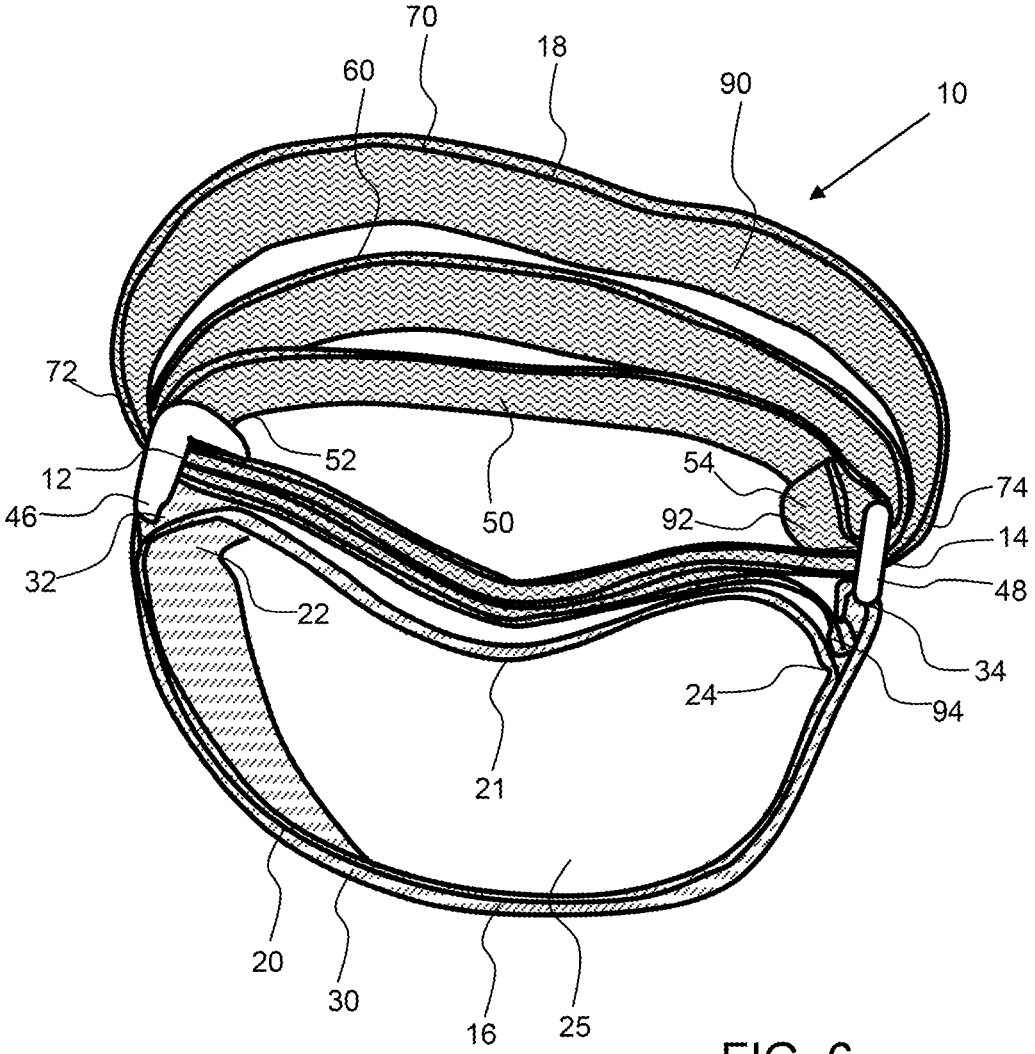
FIG. 6 shows an exemplary yoga band having a three pose straps that are formed by a pose strap coil that extends through a first and second buckle on the first and second sides, respectively, of the yoga band.

As shown in FIG. 6, the yoga band has three pose straps including an outer pose strap 70, an inner pose strap 50 and an intermediate pose strap 60 configured between the outer and inner pose straps. The three pose straps are formed by a pose strap coil 90 that has a first fixed end 92 on the buckle 48 on the second side and extends through the first buckle 46 on the first side and coils through the buckles to form the three pose straps. A fixed second end 94 of the pose strap coil is configured on the second side 14 of the yoga band 10 and may be coupled with the retainer strap component 30 or to a buckle loop 48. The retainer band loop 20 is also secured to the buckles has a retainer strap component 30 and retrain pose strap component 21.

Figure 7:
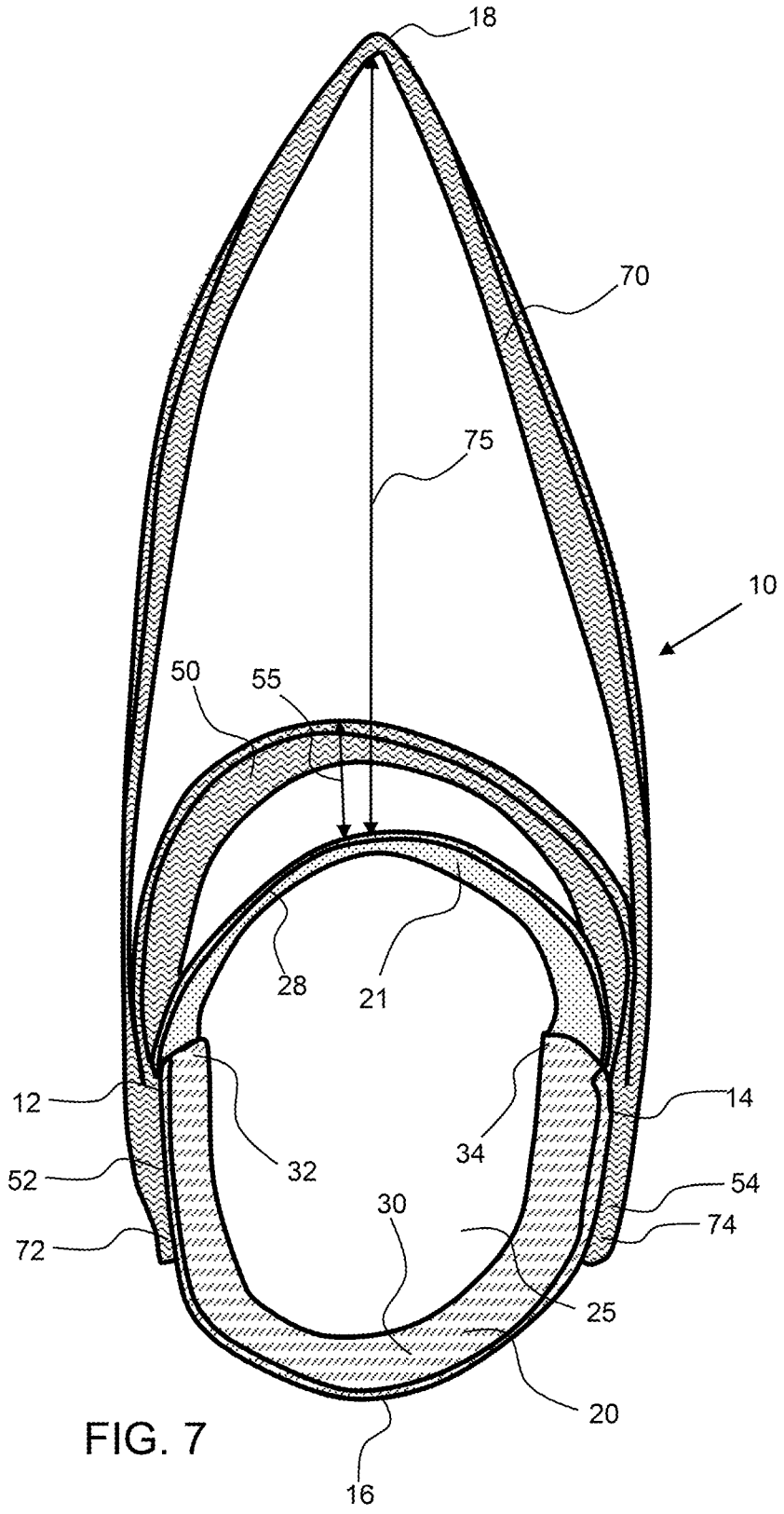
FIG. 7 shows an exemplary yoga band with the outer pose strap extended an extension length from the retainer band loop.

As shown in FIG. 7, an exemplary yoga band 10 is configured with the outer pose strap 70 extended an extension length 75 from the retainer band loop 20. Note that the extension length of the inner band loop 55 is much shorter as it is not being stretched.

Figure 8:
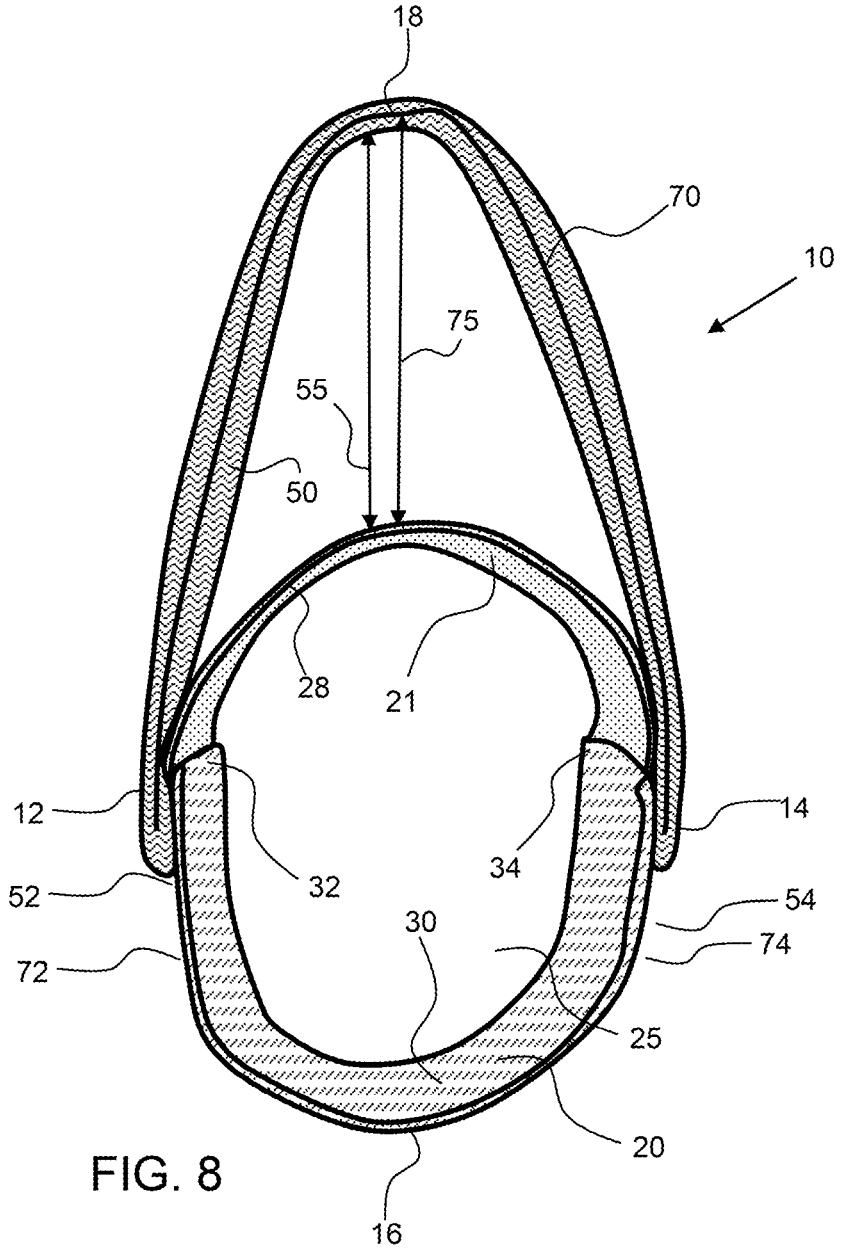
FIG. 8 shows an exemplary yoga band with the inner pose strap extended an extension length from the retainer band loop.

As shown in FIG. 8, an exemplary yoga band 10 is configured with the inner pose strap 50 extended an extension length 55 from the retainer band loop 20. The outer pose strap 70 may be combined with the inner pose strap and stretched slightly as well to an extension length 75.

Figure 9:
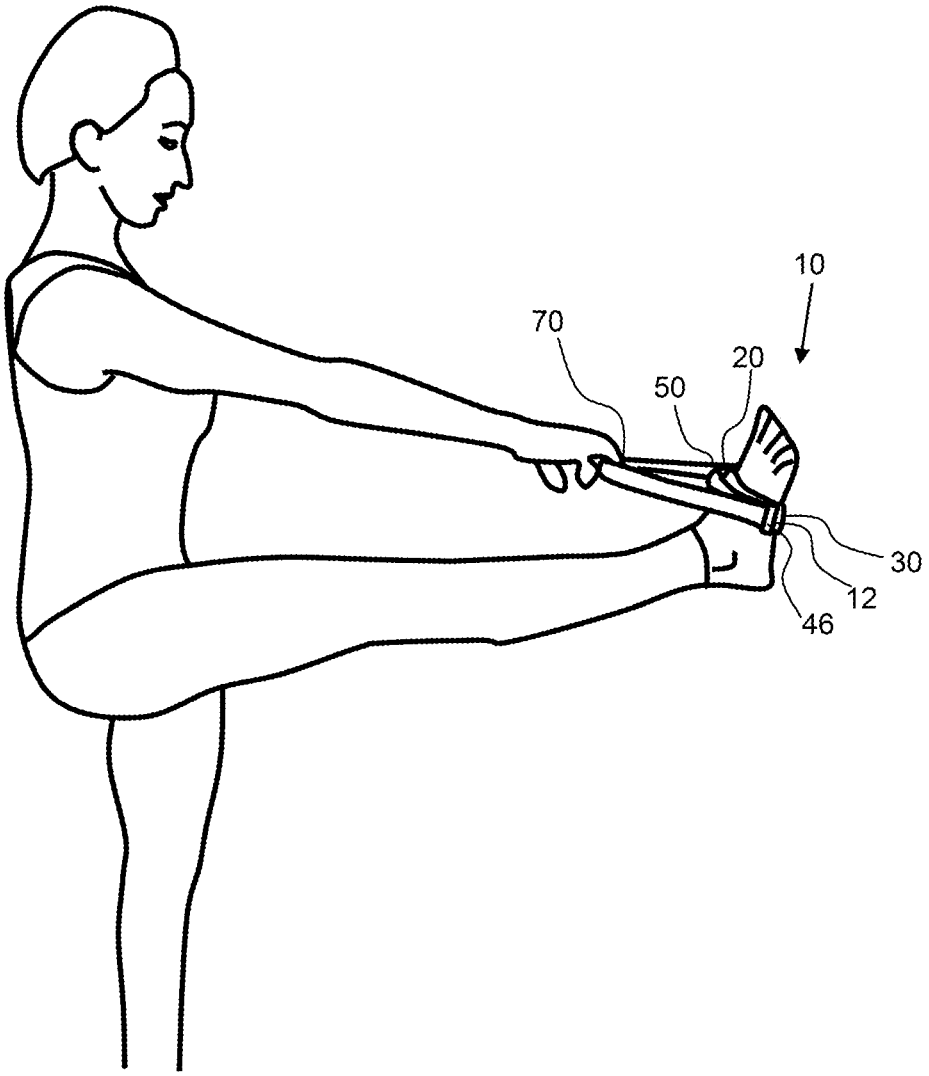
FIG. 9 shows a woman with an exemplary yoga band configured on her foot and stretching using the outer pose strap.

As shown in FIG. 9, a woman has an exemplary yoga band 10 coupled to her foot with the retainer band loop 20 configured around her foot. She is extending the outer pose strap 70 and the retainer strap component 30 secures the yoga band to the bottom of her foot. The inner pose strap 50 may also be used to increase the stretch as it is smaller in length than the outer pose strap. The retainer pose strap component is configured snug to the top of her foot. This yoga band has a buckle 46 on the first side 12.

Figure 10:
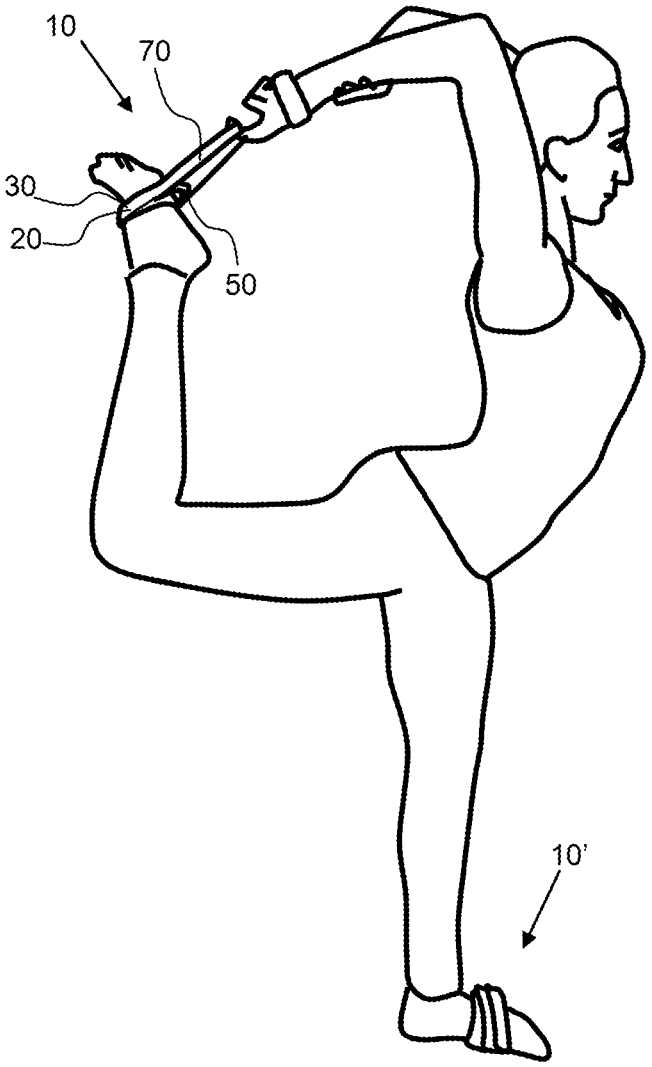
FIG. 10 shows a woman with an exemplary yoga band configured on her foot and stretching using the outer pose strap.

As shown in FIG. 10, a woman has an exemplary yoga band 10 coupled to her foot with the retainer band loop 20 configured around her foot. She is extending the outer pose strap 70 and the retainer strap component 30 secures the yoga band to the top of her foot. The inner pose strap 50 may also be used to increase the stretch as it is smaller in length than the outer pose strap. The retainer pose strap component is configured snug to the bottom of her foot. A second yoga band 10' is configured on her other foot.

Figure 11:
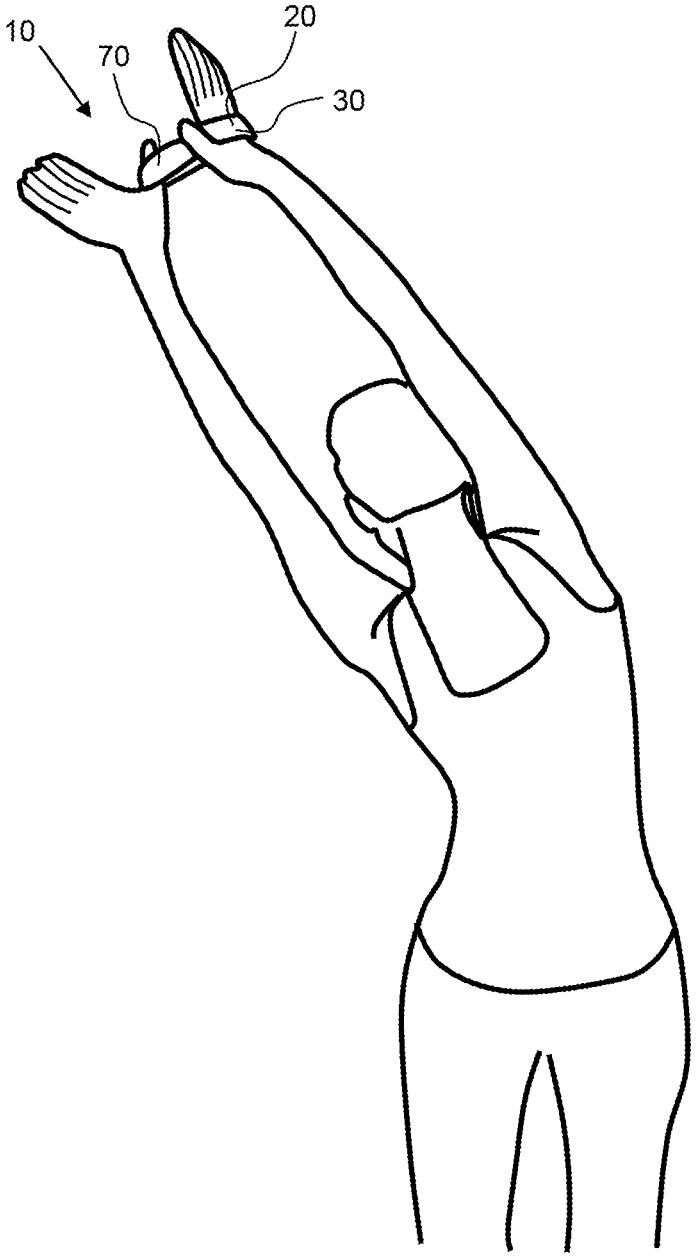
FIG. 11 shows a woman with an exemplary yoga band configured on her right hand and extending the outer pose strap with her left hand.

As shown in FIG. 11, a woman has an exemplary yoga band 10 coupled to her hand with the retainer band loop 20 configured around her right hand. She is extending the outer pose strap 70 with her left hand and the retainer strap component 30 secures the yoga band to the back of her right hand. The retainer pose strap component is configured snug to the palm of her right hand.

Figure 12:
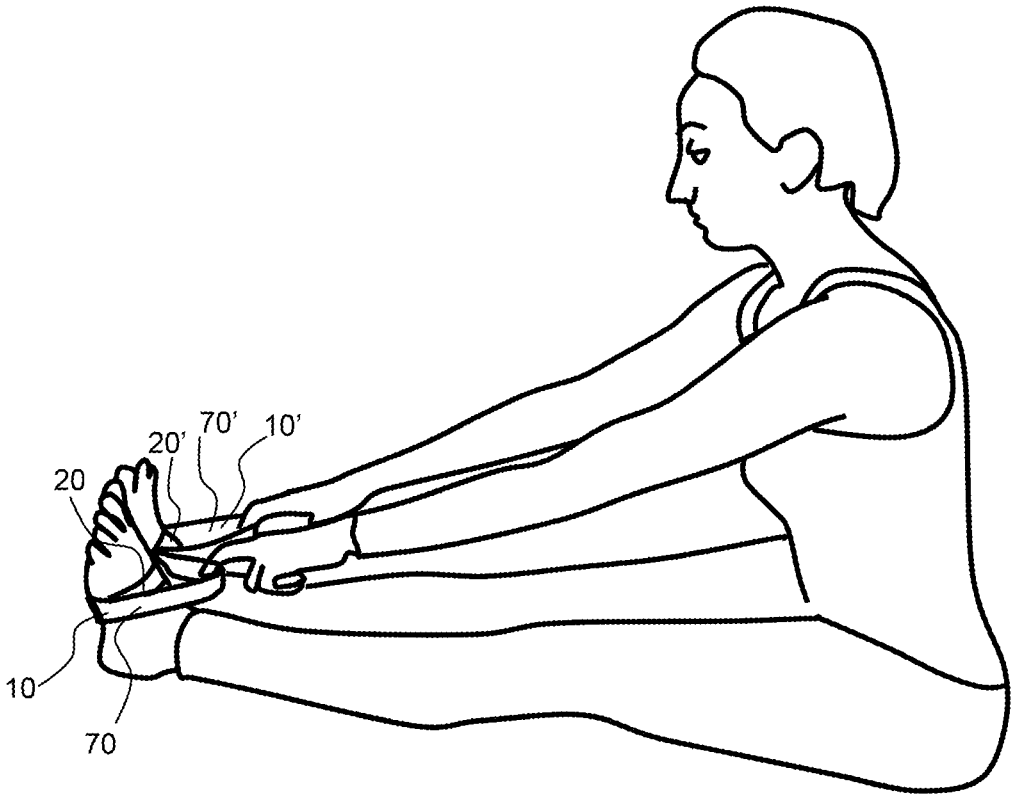
FIG. 12 shows a woman with two exemplary yoga bands configured around her feet with the outer pose straps being stretched with her hands.

FIG. 12 shows a woman with two exemplary yoga bands 10, 10' configured around her feet and the outer pose straps 70, 70' being extended or stretched with her hands.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A yoga band comprising:

a) a first side, b) a second side, c) a retaining end;

d) a pose end;

e) a retainer band loop comprising:

i) a retainer strap component extending along the retaining end from said first side to said second side of the yoga band;

ii) a retainer pose strap component extending from said first side to said second side and coupled to the retainer strap component to form a retainer loop opening;

f) an inner pose strap coupled to the retainer band loop on the first side and the second side and extending over the retainer pose strap component proximal to the pose end;

g) an outer pose strap coupled to the retainer band loop on the first side and the second side and extending over the inner pose strap and forming the pose end;

wherein the inner pose strap and outer pose strap are elastic;

wherein the retainer strap component is non-elastic;

wherein the retainer pose strap component forms a loop; and wherein a portion of the retainer pose strap component forms a concentric overlap portion with the retainer strap component.

2. The yoga band of claim 1, wherein the concentric overlap portion of the retainer pose strap component is attached to the retainer strap component on the first side and second side of the yoga band.

3. The yoga band of claim 1, wherein the concentric overlap portion of the retainer pose strap component is attached to the retainer strap component along the concentric overlap portion.

4. The yoga band of claim 1, wherein the retainer strap component and retainer pose strap component are attached on the first side and the second side.

5. The yoga band of claim 1, wherein the retainer strap component and retainer pose strap component are attached on the first side and the second side by stitching.

6. The yoga band of claim 1, wherein the retainer strap component comprises a first retainer extension and a second retainer extension, wherein each of the first and second retainer extensions comprises a hook-and-loop fastener to detachably attach the first and second retainer extensions together and to enable changing the retainer loop opening size.

7. The yoga band of claim 1, further comprising a buckle on the first side of the yoga band and wherein the retainer band loop extends through the buckle.

8. The yoga band of claim 7, wherein the retainer strap component is coupled to the buckle.

9. The yoga band of claim 8, wherein the retainer pose strap component is coupled to the buckle.

10. The yoga band of claim 9, wherein the retainer pose strap component is looped through the buckle.

11. The yoga band of claim 8, wherein the retainer strap component is looped through the buckle.

12. The yoga band of claim 11, wherein the retainer pose strap component is looped through buckle.

13. The yoga band of claim 7, further comprising a second buckle configured on the second side of the yoga band and wherein the retainer band loop extends through the second buckle.

14. The yoga band of claim 13, wherein the retainer strap component is coupled to the second buckle.

15. The yoga band of claim 14, wherein the retainer pose strap component is coupled to the second buckle.

16. The yoga band of claim 14, wherein the retainer pose strap component is looped through the second buckle.

17. The yoga band of claim 14, wherein the retainer strap component is looped through the second buckle.

18. The yoga band of claim 17, wherein the retainer pose strap component is looped through the second buckle.

19. The yoga band of claim 1, wherein the outer pose strap has a length from the first side to the second side of the retainer band loop of no more than 30 cm.

20. The yoga band of claim 1, wherein the inner pose strap has an extension length of no more than 30 cm.

21. A yoga band comprising:

a) a first side, b) a second side, c) a retaining end;

d) a pose end;

e) a retainer band loop comprising;

i) a retainer strap component extending along the retaining end from said first side to said second side of the yoga band;

ii) a retainer pose strap component extending from said first side to said second side and coupled to the retainer strap component to form a retainer loop opening;

f) an inner pose strap coupled to the retainer band loop on the first side and the second side and extending over the retainer pose strap component proximal to the pose end;

g) an outer pose strap coupled to the retainer band loop on the first side and the second side and extending over the inner pose strap and forming the pose end;

h) a buckle on the first side of the yoga band and wherein the retainer band loop extends through the buckle;

wherein the inner pose strap and outer pose strap are elastic;

i) a second buckle configured on the second side of the yoga band and wherein the retainer band loop extends through the second buckle; and wherein the inner pose strap and outer pose strap are a continuous strap that is a pose strap coil that extends through the buckle.

22. The yoga band of claim 21, wherein the pose strap coil extends through the second buckle.

23. The yoga band of claim 22, wherein the pose strap coil slides through the buckles to allow further extension of the inner or outer pose strap.

24. The yoga band of claim 22, wherein the pose strap coil forms an intermediate pose strap.

25. A yoga band comprising:

a) a first side, b) a second side, c) a retaining end;

d) a pose end;

e) a retainer band loop comprising:

i) a retainer strap component extending along the retaining end from said first side to said second side of the yoga band;

ii) a retainer pose strap component extending from said first side to said second side and coupled to the retainer strap component to form a retainer loop opening;

f) an inner pose strap coupled to the retainer band loop on the first side and the second side and extending over the retainer pose strap component proximal to the pose end;

g) an outer pose strap coupled to the retainer band loop on the first side and the second side and extending over the inner pose strap and forming the pose end;

wherein the inner pose strap and outer pose strap are elastic; and wherein the inner pose strap and outer pose strap are a continuous strap.

26. The yoga band of claim 25, wherein the inner pose strap and outer pose strap are a continuous strap that forms a pose strap coil.

* * * * *